US005440958A

United States Patent [19]

Terasaki et al.

[11] Patent Number: 5,440,958

[45] Date of Patent: Aug. 15, 1995

[54] AUTOMATIC DEVICE FOR STACKING SHEETS OF PAPER

[75] Inventors: Hiroyuki Terasaki; Masahiro Sekine; Hisanori Miyake; Michael T. Sherick; Bryan M. Doherty, Jr., all of Kanagawa, Japan

[73] Assignee: Japan Digital Laboratory Co., Ltd., Tokyo, Japan

[21] Appl. No.: 112,096

[22] Filed: Aug. 26, 1993

[30] Foreign Application Priority Data

Mar. 2, 1993 [JP] Japan ..... 5-067638

[51] Int. Cl.[6] ..... B65H 31/00

[52] U.S. Cl. ..... 83/83; 271/175; 271/213

[58] Field of Search ..... 83/83, 86; 271/175, 271/207, 213

[56] References Cited

U.S. PATENT DOCUMENTS 3,167,311 1/1965 Windmiller ..... 271/175
3,612,510 10/1971 Dickson ..... 271/175 X
3,704,884 12/1972 Nicolay et al. ..... 271/175
3,712,609 1/1973 Robert ..... 271/175
5,179,880 1/1993 Sherick ..... 83/83
5,188,352 2/1993 Bartman et al. ..... 271/175

FOREIGN PATENT DOCUMENTS 826920 1/1952 Germany ..... 271/175

*Primary Examiner*—Richard K. Seidel
*Assistant Examiner*—Raymond D. Woods
*Attorney, Agent, or Firm*—Flynn, Thiel, Boutell & Tanis

[57] ABSTRACT

An automatic device for stacking sheets of paper is improved for increasing the amount of stacked sheets. An image tracing output device is so constructed that a sheet exiting from a sheet exit portion is guided to the exterior of a fixed rod of sheet stacking unit by a plate for putting sheet flow in good order. When the forwarded amount of the sheet attains approximately a half of a predetermined length, a contacting portion supported by swinging rods descends to be brought into contact with the sheet. The contacting portion continues to descend further to be brought into contact with the fixed rod. As the result, the sheet is hung also on the inner side of the fixed rod. When it attains a predetermined length, it is cut and the swinging rods return to their initial position.

18 Claims, 8 Drawing Sheets

AUTOMATIC DEVICE FOR STACKING SHEETS OF PAPER

FILED OF THE INVENTION

The present invention relates to improvement of an automatic device for stacking sheets of paper suitable to an image tracing output device in an electronic apparatus such as a CAD device using a computer.

BACKGROUND OF THE INVENTION

A prior art device for stacking sheets of paper of relatively large size exiting from the image tracing output device after completion of an image tracing operation therein was constructed generally so that the sheets of paper were stacked in a horizontal state or in an inclined state nearly horizontal.

Recently a large scale image tracing output has become possible, accompanied by mechanical and functional improvement of various sorts of image tracing output devices. Together therewith, there is a trend that the size of exiting sheets of paper becomes greater and greater. Nevertheless, in most of devices for stacking such sheets of paper the sheets are stacked in a horizontal or quasi-horizontal state as in prior art devices.

However, when a device is so constructed that exiting sheets are stacked in a horizontal or quasi-horizontal state as described above, a sheet stacking portion having an area, which is at least equal to or greater than the area of the used sheets is necessary and at the same time means for supporting such a sheet stacking portion should be necessarily large and have a high rigidity.

Therefore the same applicant has filed Japanese patent application No. Hei 3-253033 (U.S. Pat. No. 5,179,880) in view of reducing the size and simplifying the construction of such a device for stacking sheets of paper, by improving such construction that exiting sheets after image tracing are stacked in a horizontal state and by making it possible to stack sheets in a state where each of them is folded in two at an approximate center in the longitudinal direction thereof to be hung.

FIGS. 4 and 5 show a device disclosed in said patent application described previously. In the figures reference numeral 1 represents a sheet of paper and 2 indicates an image tracing output device, in which an output shaft of a motor 6 is linked with a part of a driving shaft 4 supported so as to be parallel to a sheet exit opening 3, through which the sheet 1 is forwarded after image tracing, through transmitting means 5, so that the driving shaft 4 can be rotated by the motor 6.

Swinging rods 7 and 7 are secured to two end portions of the driving shaft 4, respectively, so as to protrude to the exterior through vertical elongated holes formed in a vertical wall 8, in which the sheet exit opening 3 is also formed, and a sheet stacking rod 9 is disposed parallelly to the sheet exit opening 3 so as to connect the extremities of the two swinging rods 7 and 7.

Further a limit switch 11 serving as an end limiting sensor and a limit switch 12 serving as a start limiting sensor are disposed at rotational positions corresponding to two ends of a predetermined region where the sheet stacking rod 9 is movable and contacting pieces 10 and 10 are formed on the driving shaft 4 so that they can be brought into contact with these limit switches 11 and 12, respectively, in order to control opening and closing of a circuit connected with the motor 6.

FIGS. 6A to 6D show an example of operation of the device described above. In the case where the sheet 1 is continuous, when it is forwarded by a predetermined length, the sheet stacking rod 9 is swung so that the swinging rods 7 and 7 move upward. A contacting piece 14*a* disposed on a lower surface of the extremity of a stopper 14 is brought into contact with the sheet 1 so that the sheet 1 is put between the contacting piece 14*a* and the sheet stacking rod 9 and the sheet is cut in this state. Thereafter the sheet stacking rod 9 moves downward to return to its initial position.

A problem in the device disclosed in said application described above consists in the construction, wherein the sheet stacking rod 9 is swung for every exit of sheet of paper so that the sheet of paper is hung and kept thereby. That is, since the sheet stacking rod 9 is provided in common with a function to fold the sheet in two and with another function to hang that sheet, the number of sheets which can be stacked is limited, because rotation load of the sheet stacking rod is excessively increased by the weight of sheets, when the number of sheets exceeds a certain value.

It was not possible to avoid that the size of the driving system was increased, if it was tried to remove this limitation.

OBJECT OF THE INVENTION

The object of the present invention is to provide an automatic device for stacking sheets of paper capable of solving such a problem and increasing considerably the number of sheets, which can be stacked.

SUMMARY OF THE INVENTION

In order to achieve the above object, an automatic device for stacking sheets of paper is characterized in that it comprises sheet stacking means disposed below a sheet exit portion of an image tracing output device; sheet guiding means for guiding each sheet exiting from the sheet exit portion described above, towards one side of the sheet stacking means; and sheet exit direction changing means, which thrusts the sheet to the sheet stacking means, when the sheet which has exited has a predetermined length, so as to change an exit direction thereof to another side of the sheet stacking means.

When the sheet exits from the image tracing output device, it is guided to one side of the sheet stacking means. When the sheet has the predetermined length, it is thrust to the sheet stacking means and the exit direction thereof is changed to the other side of the sheet stacking means. In this way the sheet is supported in a state where it is hung by this sheet stacking rod.

DETAILED DESCRIPTION

Figure 1:
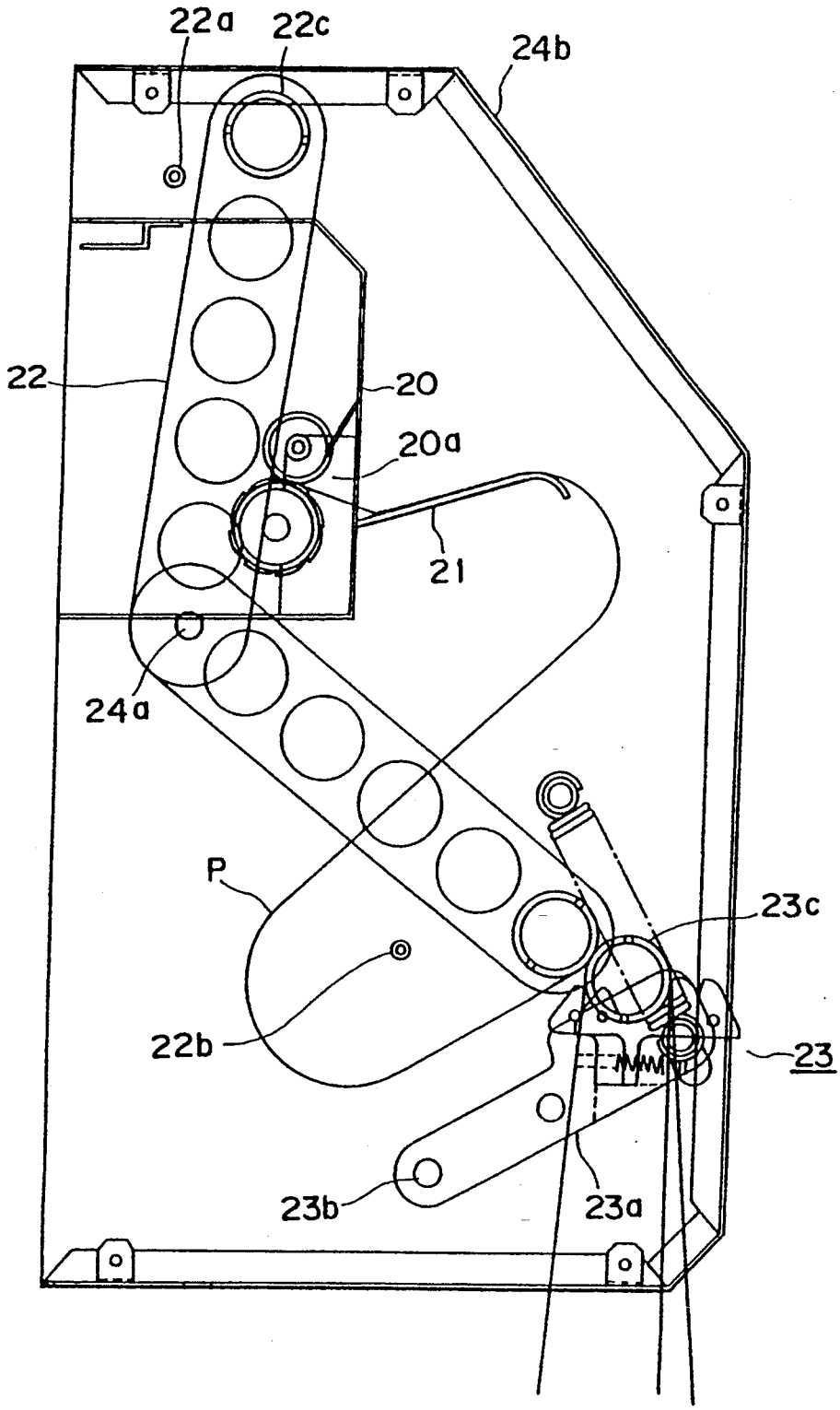
FIG. 1 is a diagram showing schematically the construction indicating an embodiment of the present invention.

Hereinbelow several embodiments of the present invention indicated in the drawings will be explained.

Figure 2:
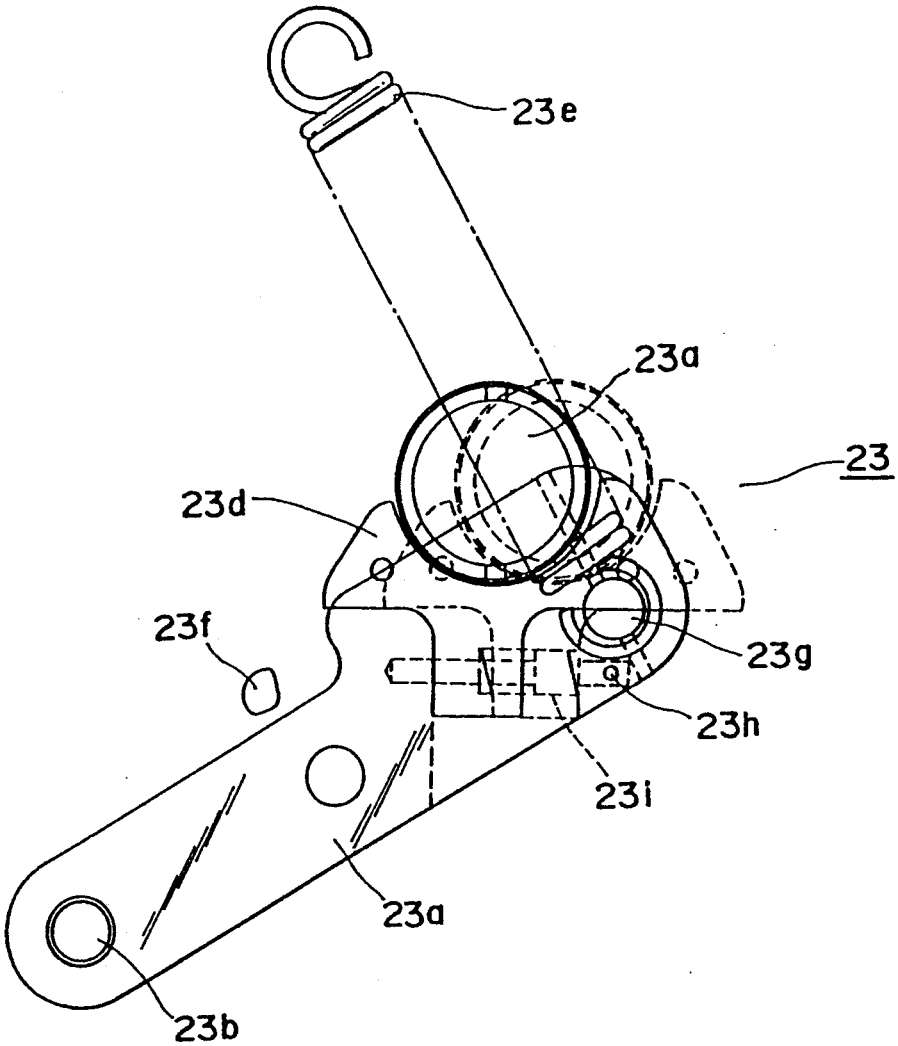
FIG. 2 is a diagram schematically an example of the construction of a sheet stacking means in the above embodiment.

FIGS. 1 and 2 show an embodiment of the automatic device for stacking sheets of paper according to the present invention. In these figures reference numeral 20 represents a sheet exit portion in an image tracing output device, which comprises a roller 20*a* for forwarding a sheet of paper, a sheet cutter not indicated in FIG. 1, etc. 21 is a plate for putting a flow of sheets in good order, which is disposed on an opening portion of the sheet exit portion 20, directed upward by 0° to 30° with respect to the horizon, and which corresponds to the sheet guiding means described previously.

22 is a swinging rod serving as the sheet exit direction changing means described previously, which is supported pivotally so as to be able to go and return up and downward. Since pivoting driving means therefor may be identical to that used in the device disclosed in said application described previously, it is omitted to indicate it in FIG. 1. 22*a* and 22*b* are an upper and a lower stopper for the swinging rod 22 and 24*b* is a cover.

23 is the sheet stacking means described above, which is constructed e.g. as indicated in FIG. 2. In the same figure, 23*a* is a supporting table supported pivotally around a pivot 23*b*. 23*c* is a fixed rod long in the direction perpendicular to the sheet of figure, whose two extremities are mounted on fixed rod receiving portions 23*d* on the supporting table 23*a* so as to be approximately parallel to the opening portion in the sheet exit portion 20 of the image tracing output device. Consequently the supporting table 23*a* is located at the two extremities of the fixed rod 23*c*. Further, since the fixed rod 23*c* is mounted on the receiving portion 23*d* dismountably, sheets stacked on the fixed rod 23*c* as described later can be easily taken-out for every fixed rod 23*c*.

One end of a spring 23*e* is engaged with an engaging portion of the supporting table 23*a* so that the supporting table 23*a* is pulled thereby upto the position of a stopper 23*f* at no load where no sheets are stacked thereon. When the swinging rod 22 is descended, the supporting table 23*a* stops at a position where downward force applied to the swinging rod 22 and upward force applied to the fixed rod 23*c* are balanced, when they are brought into contact with each other.

A guide pin 23*h* disposed on the rear surface of the supporting table 23*a* is inserted in a hole formed in the fixed rod receiving portion 23*d* so that biasing force of a spring 23*i* is applied thereto. The position of the fixed rod receiving portion 23*d* in the supporting table can be regulated in the left and right direction in the figure by using the spring 23*i*. As described above, owing to the operation of the springs 23*e* and 23*i*, the swinging rod 22 can support sheets at a same position, even if the amount of stacked sheets increases.

Figure 7A:
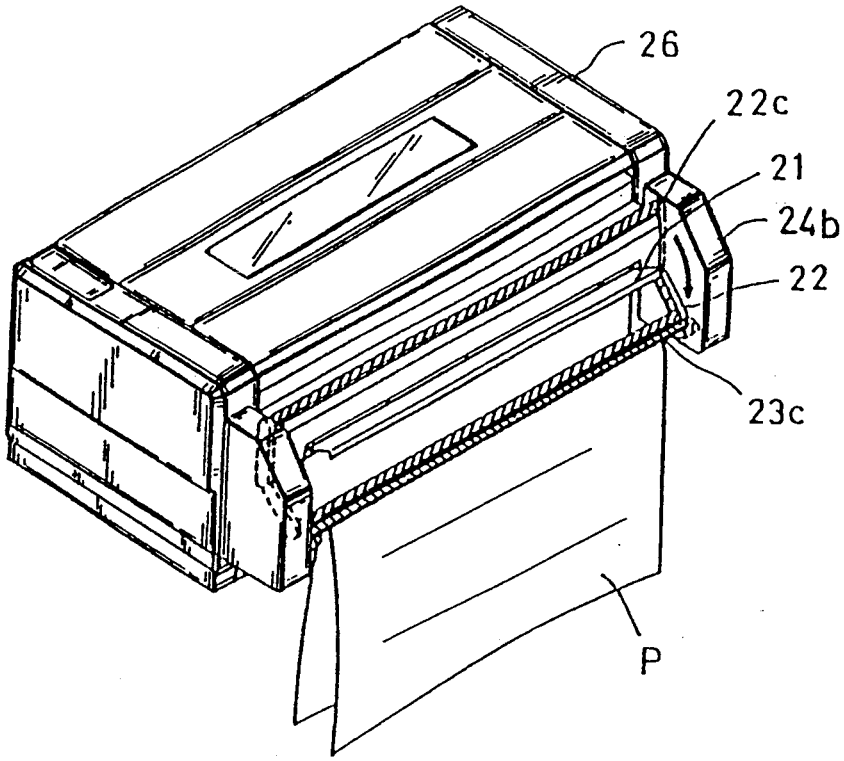
FIGS. 7A and 7B are perspective views showing the whole construction of the above embodiment.
Figure 7B:
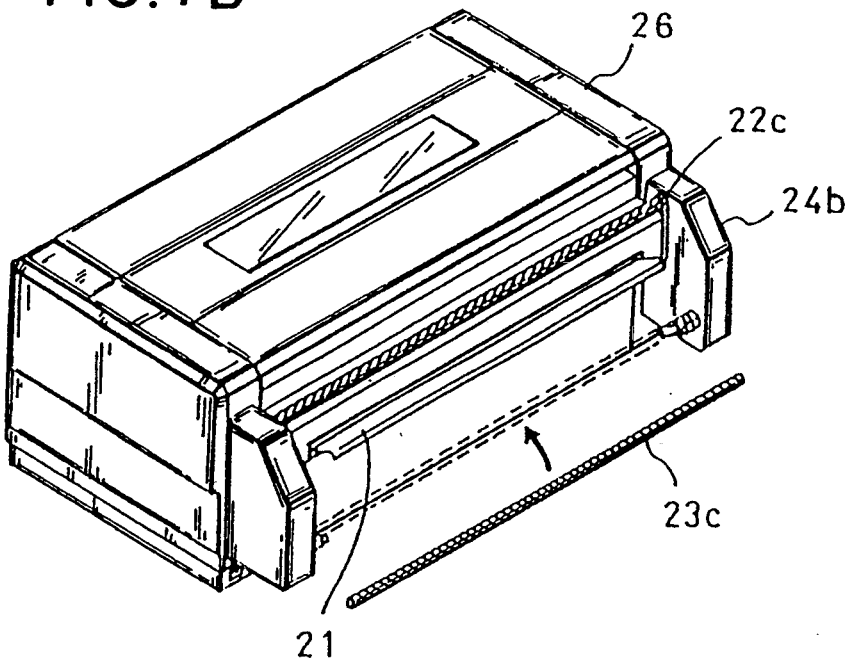

FIG. 7A indicates a state where the present device is mounted on the image tracing output device 26 and FIG. 7B shows how to dismount the fixed rod 23*c*.

Next the operation of the automatic device for stacking sheets of paper in the embodiment described above will be explained.

Figure 3A:
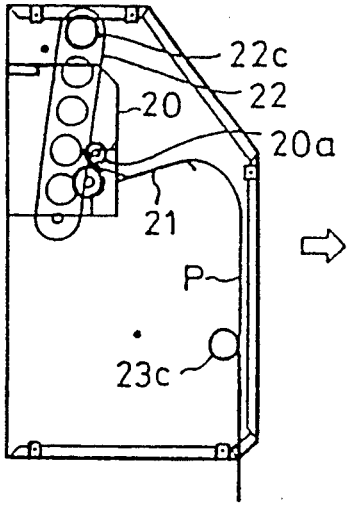
FIGS. 3A to 3H are diagrams for explaining the operation of the above embodiment.

FIGS. 3A to 3H indicate the order of various steps in this operation. At first, as indicated in FIG. 3A, a sheet P exiting from the sheet exit portion 20 is guided on the plate 21 for putting sheet flow in good order to be hung on the outer side (right side in the figure) of the fixed rod 23*c*. In FIGS. 3A to 3H, in order to make the explanation more understandable, only the fixed rod 23*c* is indicated for the sheet stacking means 23.

Figure 3B:
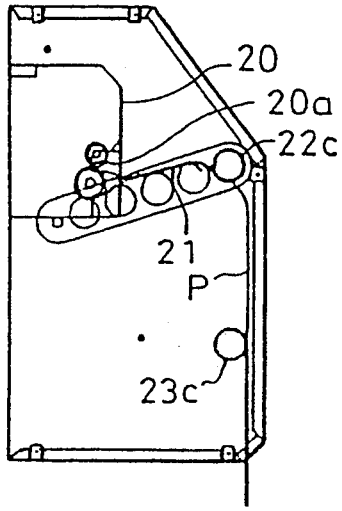
Figure 3C:
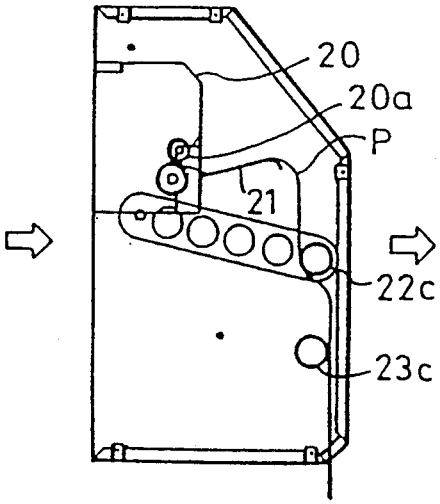
Figure 3D:
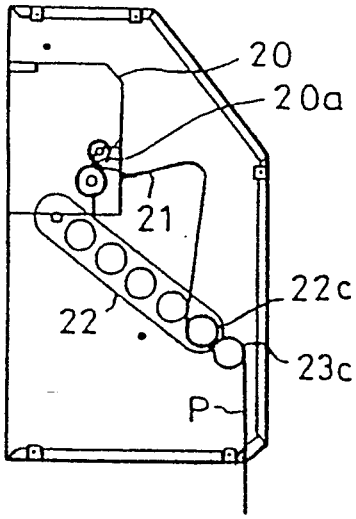
Figure 3E:
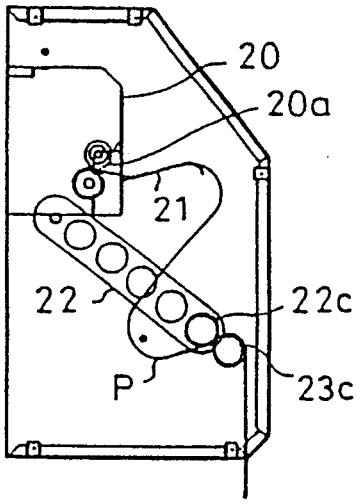
Figure 3F:
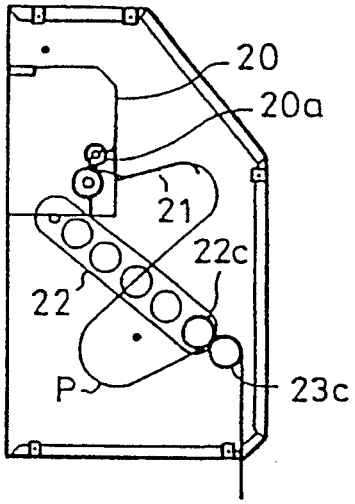

In this state, when it is sensed by means not indicated in the figure that the forwarded amount of the sheet P attains approximately a half of a predetermined length, the swinging rod 22 begins to descend, as indicated in FIG. 3B and the contacting portion 22*c* of the swinging rod 22 is brought into contact with the sheet P. When the swinging rod 22 descends further, as indicated in FIG. 3C, the sheet P begins to be bent towards the inner side (left side in the figure) of the swinging rod 22. The swinging rod 23*c* continues to descend and the sheet P is put between the fixed rod 23*c* and the contacting portion 22*c* on the inner side of the fixed rod 23*c*, as indicated in FIG. 3D, to be fixed there. As the result, as indicated in FIG. 3E, the sheet P is loosened and becomes inversed S-shaped on the inner side (left side in the figure) of the fixed rod 23*c*.

Figure 3G:
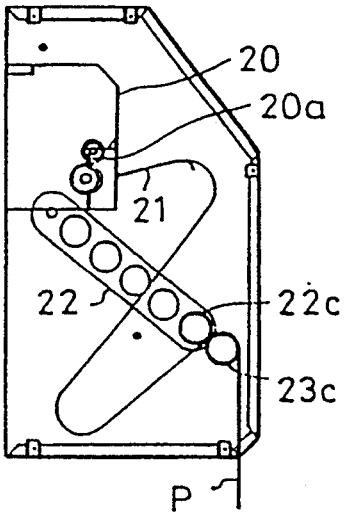
Figure 3H:
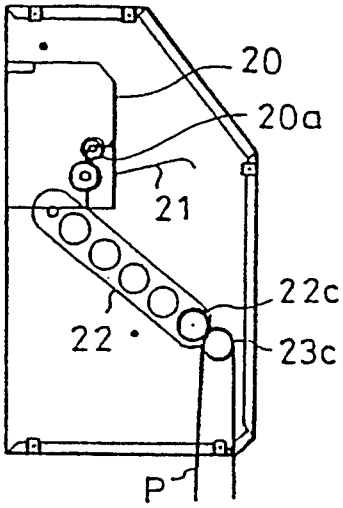
Figure 4:
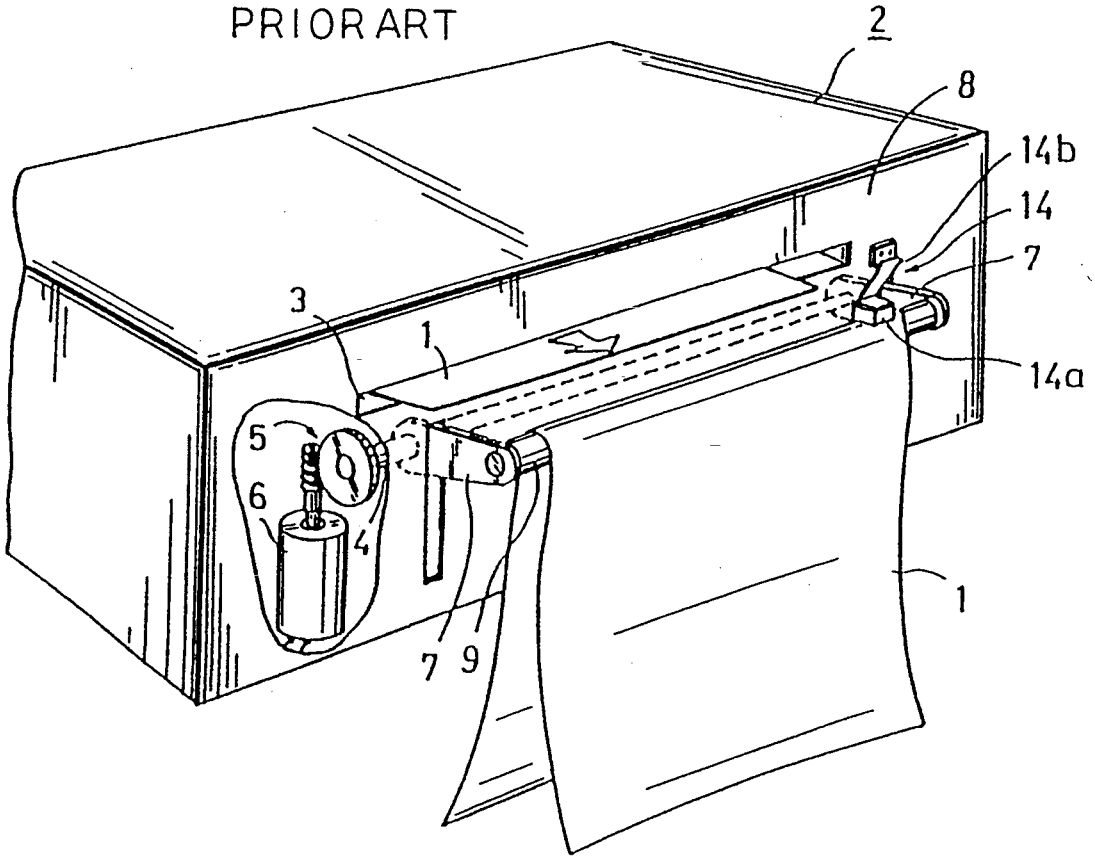
FIG. 4 PRIOR ART
FIG. 4 is a perspective view showing a principal part of an image tracing output device described in the older application.
Figure 5:
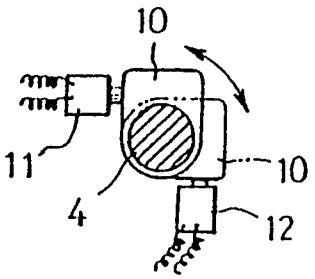
FIG. 5 PRIOR ART
FIG. 5 is a cross-sectional view showing the relation between a driving shaft and limit switches in the device indicated in FIG. 4.
Figure 6A:
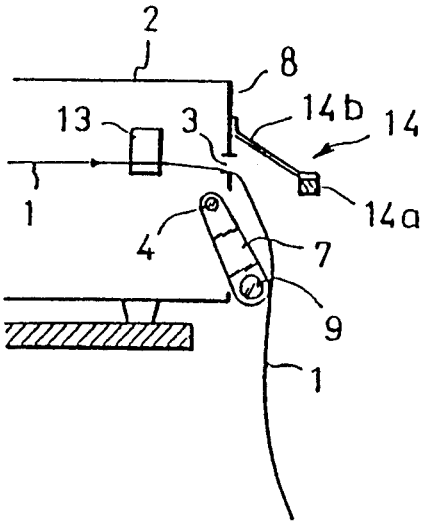
FIG. 6A PRIOR ART
FIGS. 6A to 6D are diagrams for explaining the operation of the device indicated in FIG. 4.
Figure 6C:
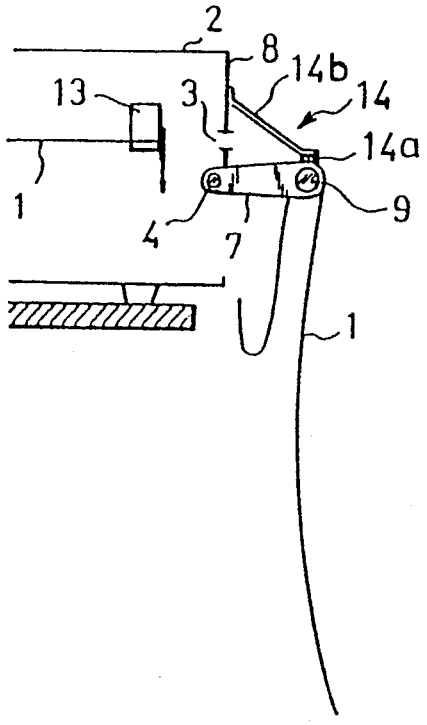
FIG. 6C PRIOR ART
Figure 6B:
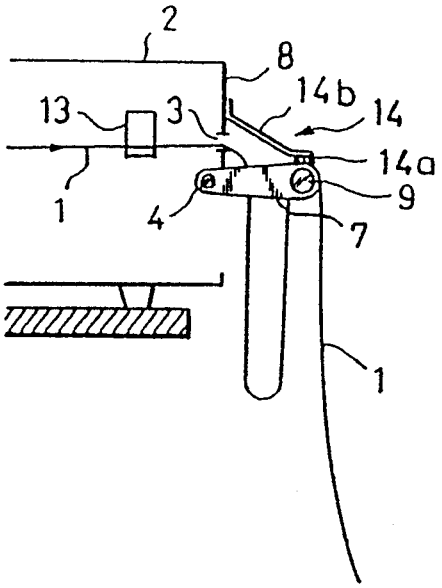
FIG. 6B PRIOR ART
Figure 6D:
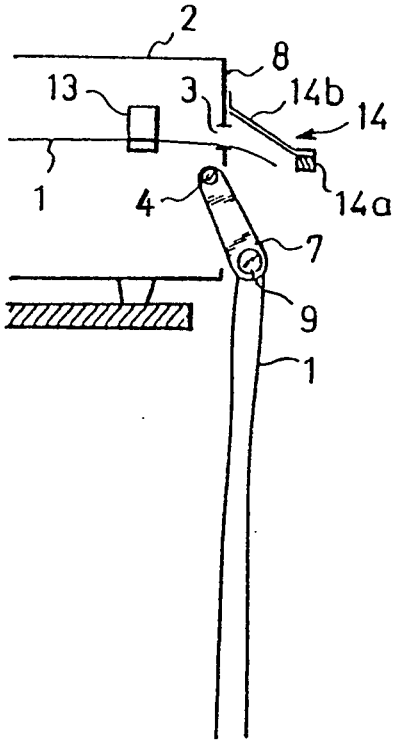
FIG. 6D PRIOR ART

Since the sheet P continues to exit, looseness in the inversed S shape described above increases, as described in FIG. 3F, and the loosened part protrudes downward, as indicated in FIG. 3G. When it is sensed that the forwarded amount of the sheet P attains the predetermined length described previously, the sheet P is cut. Thus, the rear end of the sheet P falls by the own weight and it is stacked on the fixed rod 23*c*. Then the swinging rod 22 rises to return to its original position.

Although the sheet stacking means can be constructed in various ways other than that described above, particularly in the case where it is constructed as described above, effects as described below are obtained.

(i) Although the supporting table 23*a* is usually thrust to the position of the stopper 23*f* by the spring 23*e*, since the fixed rod receiving portion 23*d* can dodge to the right in the figure by a horizontal component of the pressure at that time, when the contacting portion 22*c* is brought into contact with the fixed rod 23*c*, a good contact angle and contact pressure can be always kept, independently of the amount of stacked sheets of paper.

(ii) The fixed rod 23*c* is movable up and downward and it is located usually at the position of the stopper 23*f* by the spring 23*e*. When the amount of stacked sheets increases, the fixed rod dodges downward, when the swinging rod 22 descends. Consequently it is prevented that the swinging rod 22 is excessively loaded.

Figure 8A:
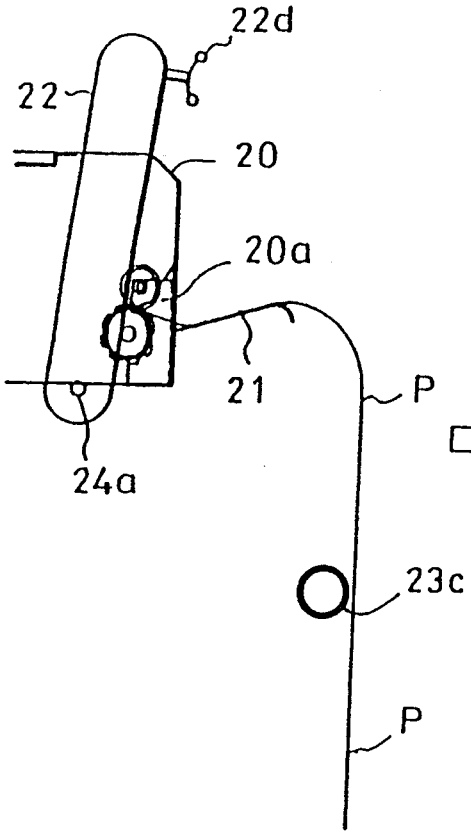
FIGS. 8A and 8B are schematical diagrams showing a modified example of the above embodiment.
Figure 8B:
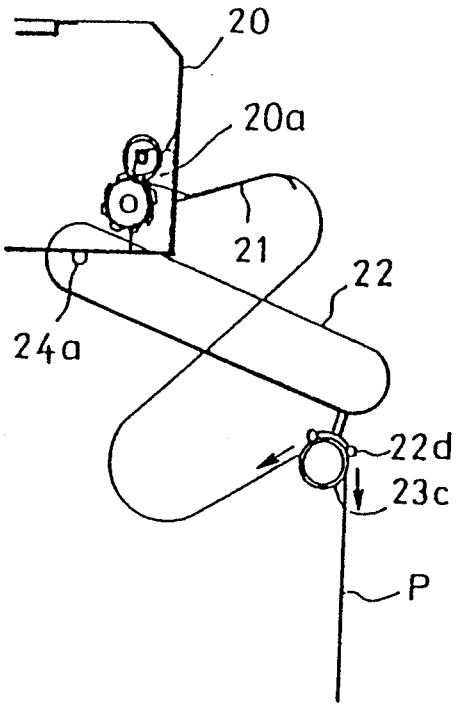

Further, in lieu of the contacting portion 22*c* described above, a thrusting member having rollers 22*d* (or protrusions) as indicated in FIGS. 8A and 8B may be used. In this way, since the relevant member is in contact with the sheet P at least at two positions, it is prevented that the sheet falls and stability of the sheet stacking state is increased.

As explained above, according to the present invention, various effects as an automatic device for stacking sheets of paper can be obtained and main effects among them can be cited as follows.

(i) The number of sheets, which could be stacked, was heretofore about 50. Contrarily thereto, according to the present invention, it can be increased about two to three times, i.e. to about 100 to 150.

(ii) It is possible to accommodate efficiently sheets of large format in the smallest space.

(iii) The mechanism is simple. Thus it has a high operability and can reduce the cost.

(iv) The function to stack sheets of large size provided by the present invention is suitable for apparatuses such as a plotter, an apparatus for facsimile, a copier, etc. of large size. Since a great amount of sheets outputted from these apparatuses can be stacked automatically, it is very convenient for nightly running of these apparatuses.

(v) It can be used not only for a continuous sheet of paper but also for various sorts of sheets of paper. In addition a very low deficient stacking ratio can be obtained.

(vi) In the case where a dismountable fixed rod is used as the sheet stacking means, the fixed rod can be easily moved to an arbitrary position together with stacked sheets. In addition it is possible also to suitably hang the fixed rod by means of a hanger or install it on a rack, etc. to stock the sheets.

What is claimed is:

1. An automatic device for stacking sheets of paper comprising:

an image tracing output device having a sheet exit portion adapted to facilitate an exit of a sheet of paper therefrom;

sheet stacking means disposed below the sheet exit portion of the image tracing output device and having a sheet supporting rod which has a spring at each extremity thereof engaged therewith so that said sheet supporting rod moves in directions toward and away from a downwardly extending plane oriented parallel to a surface of said sheet when a sufficient component of pressure is applied to said sheet supporting rod;

sheet guiding means, for guiding each sheet exiting from said sheet exit portion, towards one side of said sheet stacking means;

sheet exit direction changing means for thrusting said sheet to said sheet stacking means when the sheet which has exited has a predetermined length so as to change an exit direction thereof to another side of said sheet stacking means, said sheet exit direction changing means including a contact portion which is movable into contact with said sheet supporting rod to apply said component of pressure thereto; and sheet cutting means for cutting the sheet, which has exited by a predetermined length, after the sheet exit direction has been changed by said sheet exit direction changing means.

2. An automatic device for stacking sheets of paper according to claim 1, wherein said sheet exit direction changing means comprises pivoting rods disposed so as to be able to pivot, said contacting portion supported by said pivoting rods at two extremities thereof so as to pivot together therewith.

3. An automatic device for stacking sheets of paper according to claim 1, wherein said sheet guiding means comprises a plate for putting sheet flow in good order, which guides the sheet exiting from said sheet exit portion somewhat upward with respect to the horizon.

4. An automatic device for stacking sheets of paper according to claim 1, wherein said sheet exit direction changing means comprises pivoting rods disposed so as to be able to pivot said contact portion being a sheet thrusting member pivoted by said pivoting rods and constructed so as to be brought into contact at least at two positions with said sheet.

5. An automatic device for stacking sheets of paper according to claim 1, wherein said directions toward and away from said plane are horizontal relative to a base surface on which said automatic device is supported.

6. An automatic device for stacking sheets of paper comprising:

an image tracing output device having a sheet exit portion adapted to facilitate an exit of a sheet of paper therefrom;

sheet stacking means disposed below the sheet exit portion of the image tracing output device and having a sheet supporting rod which has a spring at each extremity thereof engaged therewith so that said sheet supporting rod moves upwardly and downwardly when a sufficient component of pressure is applied thereto;

sheet guiding means, for guiding each sheet exiting from said sheet exit portion, towards one side of said sheet stacking means;

sheet exit direction changing means for thrusting said sheet to said sheet stacking means when the sheet which has exited has a predetermined length so as to change an exit direction thereof to another side of said sheet stacking means, said sheet exit direction changing means including a contact portion which is movable into contact with said sheet supporting rod to apply said component of pressure thereto; and sheet cutting means for cutting the sheet, which has exited by a predetermined length, after the sheet exit direction has been changed by said sheet exit direction changing means.

7. An automatic device for stacking sheets of paper according to claim 6, wherein said sheet exit direction changing means comprises pivoting rods disposed so as to be able to pivot, said contact portion supported by said pivoting rods at two extremities thereof so as to pivot together therewith.

8. An automatic device for stacking sheets of paper according to claim 6, wherein said sheet guiding means comprises a plate for putting sheet flow in good order, which guides the sheet exiting from said sheet exit portion somewhat upward with respect to the horizon.

9. An automatic device for stacking sheets of paper according to claim 6, wherein said sheet exit direction changing means comprises pivoting rods disposed so as to be able to pivot, said contact portion being a sheet thrusting member pivoted by said pivoting rods and constructed so as to be brought into contact at least at two positions with said sheet.

10. An automatic device for stacking sheets of paper comprising:

an image tracing output device having a sheet exit portion adapted to facilitate an exit of a sheet of paper therefrom;

sheet stacking means disposed below the sheet exit portion of the image tracing output device and having a support member and a sheet supporting rod dismountably supported by said support member, said sheet supporting rod having a spring at each extremity thereof engaged therewith so that said sheet supporting rod moves in directions toward and away from a downwardly extending plane oriented parallel to a surface of said sheet when a sufficient component of pressure is applied to said sheet supporting rod;

sheet guiding means, for guiding each sheet exiting from said sheet exit portion, towards one side of said sheet stacking means; and sheet exit direction changing means for thrusting said sheet to said sheet stacking means, when the sheet which has exited has a predetermined length so as to change an exit direction thereof to another side of said sheet stacking means, said sheet exit direction changing means including a contact portion which is movable into contact with said sheet supporting rod to apply said component of pressure thereto.

11. An automatic device for stacking sheets of paper according to claim 10, wherein said sheet exit direction changing means comprises pivoting rods disposed so as to be able to pivot, said contacting portion supported by said pivoting rods at two extremities thereof so as to pivot together therewith.

12. An automatic device for stacking sheets of paper according to claim 10, wherein said sheet guiding means comprises a plate for putting sheet flow in good order, which guides the sheet exiting from said sheet exit portion somewhat upward with respect to the horizon.

13. An automatic device for stacking sheets of paper according to claim 10, wherein said sheet exit direction changing means comprises pivoting rods disposed so as to be able to pivot, said contact portion being a sheet thrusting member pivoted by said pivoting rods and constructed so as to be brought into contact at least at two positions with said sheet.

14. An automatic device for stacking sheets of paper according to claim 10, wherein said directions toward and away from said plane are horizontal relative to a base surface on which said automatic device is supported.

15. An automatic device for stacking sheets of paper comprising:

an image tracing output device having a sheet exit portion adapted to facilitate an exit of a sheet of paper therefrom;

sheet stacking means disposed below the sheet exit portion of the image tracing output device and having a support member and a sheet supporting rod dismountably supported by said support member, said sheet supporting rod having a spring at each extremity thereof engaged therewith so that said sheet supporting rod moves upwardly and downwardly when a sufficient component of pressure is applied thereto;

sheet guiding means, for guiding each sheet exiting from said sheet exit portion, towards one side of said sheet stacking means; and sheet exit direction changing means for thrusting said sheet to said sheet stacking means when the sheet which has exited has a predetermined length so as to change an exit direction thereof to another side of said sheet stacking means, said sheet exit direction changing means including a contact portion which is movable into contact with said sheet supporting rod to apply said component of pressure thereto.

16. An automatic device for stacking sheets of paper according to claim 15, wherein said sheet exit direction changing means comprises pivoting rods disposed so as to be able to pivot, said contact portion supported by said pivoting rods at two extremities thereof so as to pivot together therewith.

17. An automatic device for stacking sheets of paper according to claim 15, wherein said sheet guiding means comprises a plate for putting sheet flow in good order, which guides the sheet exiting from said sheet exit portion somewhat upward with respect to the horizon.

18. An automatic device for stacking sheets of paper according to claim 15, wherein said sheet exit direction changing means comprises pivoting rods disposed so as to be able to pivot and said contact portion is a sheet thrusting member pivoted by said pivoting rods, said sheet thrusting member being constructed so as to be brought into contact at least at two positions with said sheet.

* * * * *